US008532545B2

(12) United States Patent
Hokkyoh et al.

(10) Patent No.: US 8,532,545 B2
(45) Date of Patent: Sep. 10, 2013

(54) IMAGE FORMING APPARATUS AND IMAGE FORMING METHOD

(75) Inventors: Tomonari Hokkyoh, Ibaraki (JP); Takashi Suzuki, Ibaraki (JP); Koutarou Yamada, Ibaraki (JP); Katsuhiro Akinaga, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 235 days.

(21) Appl. No.: 12/943,336

(22) Filed: Nov. 10, 2010

(65) Prior Publication Data

US 2011/0123233 A1 May 26, 2011

(30) Foreign Application Priority Data

Nov. 20, 2009 (JP) ..... 2009-265719

(51) Int. Cl.
*G03G 15/09* (2006.01)

(52) U.S. Cl.
USPC ..... 399/269; 399/53; 399/71; 399/149; 399/150; 399/264

(58) Field of Classification Search
USPC ..... 399/53, 71, 149, 150, 264, 269
See application file for complete search history.

(56) References Cited

U.S. PATENT DOCUMENTS

| | | | | |
|---|---|---|---|---|
| 5,923,933 | A * | 7/1999 | Anzai et al. | 399/269 |
| 2010/0209127 | A1 | 8/2010 | Hokkyoh et al. | |

FOREIGN PATENT DOCUMENTS

| | | | |
|---|---|---|---|
| JP | 4-86841 | | 3/1992 |
| JP | 11-52789 | | 2/1999 |
| JP | 2892063 | | 2/1999 |
| JP | 11-102115 | | 4/1999 |
| JP | 3029648 | | 2/2000 |
| JP | 2001-75450 | | 3/2001 |
| JP | 2005062637 | A * | 3/2005 |
| JP | 2005-134776 | | 5/2005 |
| JP | 2006-201464 | | 8/2006 |
| JP | 2007-233049 | | 9/2007 |
| JP | 2007-271871 | | 10/2007 |
| JP | 2009-192821 | | 8/2009 |

OTHER PUBLICATIONS

Office Action issued in Japanese Application No. 2009-265719 on Jun. 25, 2013.

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

A developing device in an image forming apparatus includes: a first developer carrier that rotates in a same direction as a rotating direction of an image carrier of the image forming apparatus so as to supply developer to the image carrier; and a second developer carrier that rotates in a direction opposite to the rotating direction of the image carrier so as to supply the developer to the image carrier. The developing device simultaneously performs a refreshing operation of performing replacement of the developer and a filming removal operation of causing the image carrier to rotate idle while forming an image for use in the refreshing operation and causing the first and second developer carriers to rotate in their respective rotating directions.

18 Claims, 5 Drawing Sheets

IMAGE FORMING APPARATUS AND IMAGE FORMING METHOD

CROSS-REFERENCE TO RELATED APPLICATIONS

The present application claims priority to and incorporates by reference the entire contents of Japanese Patent Application No. 2009-265719 filed in Japan on Nov. 20, 2009.

BACKGROUND OF THE INVENTION

1. Field of the Invention

The present invention is directed generally to an image forming apparatus capable of removing filming formed on an image carrier and refreshing developer and to an image forming method.

2. Description of the Related Art

It is known that an image forming apparatus, such as a copier or a printer, develops an electrostatic latent image formed on a photoconductor that acts as a latent-image carrier into a visible image with developer supplied from a developing device.

The developed toner image is transferred onto a transfer member and thereafter passed to a fixing device where toner on the toner image is fused and absorbed into a recording medium by heat and pressure. Hence, a copied or printed image is obtained.

Meanwhile, from the photoconductor, from which the toner image has been transferred, the photoconductor foreign materials, such as paper powder and residual toner having not been transferred to the recording medium, are removed by a cleaning device. The photoconductor is further subjected residual-charge neutralization.

The cleaning device includes, as a member that comes into contact with the surface of the photoconductor, a cleaning blade or a cleaning brush, which allows the cleaning device to remove foreign materials from the surface of the photoconductor.

Removing foreign materials with a cleaning device can bring about a problem related to roundness and smaller diameter of toner particles that are employed in recent years to meet increasing demands for higher image quality, and a problem related to filming of toner caused by accumulation of electrostatic discharge products. The former problem is generally caused by accumulation of toner particles in a case where toner particles slip through the blade or brush.

A general cause of the latter problem is described below.

In recent years, electrostatic charger that includes an electrostatic charging member and performs electrostatic charging with the electrostatic charging member placed on or near a photoconductor is widely used as an electrostatic charging unit in an electrophotographic-image process. Although such an electrostatic charger advantageously produces a small amount of ozone by application of an alternating-current (AC) bias voltage to the electrostatic charging member as compared with a corona charger, the electrostatic charger disadvantageously produces adverse effects due to discharge products resulting from the application of the AC bias voltage. More specifically, the discharge products adhere to a surface of a photoconductor to form what is called photoconductor filming, thereby decreasing electrical resistance of the surface of the photoconductor and decreasing resolution of the latent image. As a result, a phenomenon, such as image blur and/or image deletion, is more likely to occur. The filming becomes more pronounced as the AC bias voltage increases. Such photoconductor filming disadvantageously lowers evenness of the photoconductor surface and hence induces defective cleaning of the photoconductor, thereby making quality change with time less stable.

To this end, a method of scraping off a photoconductor during image forming operation by using developer supplied from a developing device has conventionally been proposed. An example of such a technique is disclosed in Japanese Patent Application Laid-open No. H11-52789.

According to the configuration disclosed in Japanese Patent Application Laid-open No. H11-52789, when it is determined that filming needs to be removed, the photoconductor is driven intermittently or peripheral speed of the photoconductor is set to a speed lower than normal-image-forming speed, and the developer supplied from the developing device is caused to adhere to the photoconductor so that the filming is removed by scraping off the developer adhering to the photoconductor using a cleaning member. In this technique, the peripheral speed of the photoconductor is reduced to a range of 0 to 0.1 times an initial peripheral speed while a peripheral speed of a magnetic roller of the developing device is set to 2.5 times an initial peripheral speed.

An example of another method is disclosed in Japanese Patent Application Laid-open No. 2007-271871. According to this technique, an image, such as a solid image, that consumes a relatively large amount of developer is formed on a photoconductor and developed in a manner that stops toner supply to a developing device so that developer in the developing device is replaced to achieve developer refreshing.

An example of still another method is disclosed in Japanese Patent Application Laid-open No. 2009-192821. This technique is generally directed to elongated, continuous paper rather than to a sheet of recording paper, and removes filming by applying a bias voltage of opposite polarity to polarity of a developing bias voltage when "form printing", in which a same print pattern is constantly printed, is performed.

Meanwhile, filming can be formed not only with one-component developer that contains only toner but also with two-component developer that contains toner and carrier in a mixed manner. In particular, when a printout of which ratio of a toner-applied area to an area of the printout is relatively small is produced with use of two-component developer, toner in the developer is consumed little in some cases. This can enhance electrostatic buildup by friction between the toner and carrier, causing the toner to bear a relatively large amount of electric charges. Accordingly, when a small-diameter toner is employed, an amount of electrical charges per unit weight of the toner is increased, which increases electrostatic attraction of the toner to carrier. Consequently, a relatively large amount of small-diameter toner particles are contained in the developer.

When an amount of toner adhering to the carrier increases, the toner is less likely to be delivered onto an electrostatic latent image, which can result in decrease in image density.

Furthermore, toner particles charged in opposite polarities are more likely to repel one other, causing apparent bulk density of the developer to differ from its actual bulk density. This can bring about such a disadvantage that, in a situation where toner concentration is monitored by using a permeability sensor, the high apparent bulk density of the toner misleads determination of toner concentration such that the toner concentration is falsely determined as being sufficiently high even when toner density is low. This can lead to additional disadvantages, such as failure of toner supply and production of friction by carrier particles on the surface of the photoconductor resulting from insufficient toner particles.

Among the techniques for removing filming discussed above, the technique of moving a photoconductor intermittently to supply developer to thereby scrape off filming is disadvantageous in that an increase in friction force at start of traveling of the photoconductor can increase damage to the photoconductor. The technique that involves application of a bias voltage of opposite polarity when a two-component developer is used for scraping off the filming is disadvantageous in that an amount of scattering carrier particles increases, causing a developing-roller locking phenomenon to be likely to occur.

The technique related to developer refreshing is disadvantageous in requiring another operation of replacing already-supplied developer with new developer because, according to the technique, only consumption of the already-supplied developer is performed without supplying new toner.

Each of these techniques discussed above is predicated that removal of filming and developer refreshing are independently performed and that toner to be used has already been degraded over time.

To remove filming, toner that is not degraded over time yet in terms of electrostatic charging characteristics and surface characteristics is desirably used; however, filming removal according to the techniques discussed above is performed by using already-supplied toner and therefore disadvantageous in being unlikely to be efficient in filming removal nor good in developer refreshing performance. The method in the technique discussed above is also disadvantageous in re-configuring a cycle for filming removal and therefore requiring a considerable period of time for operations other than image forming.

Setting the peripheral speed of the photoconductor to be lower than normal-image-forming speed or stopping the photoconductor as with the technique disclosed in Japanese Patent Application Laid-open No. H11-52789 is disadvantageous in promoting filming contrary to expectation.

SUMMARY OF THE INVENTION

It is an object of the present invention to at least partially solve the problems in the conventional technology.

According to an aspect of the present invention, there is provided an image forming apparatus that includes an image carrier on which an electrostatic latent image is to be formed; a developing device that develops the electrostatic latent image into a toner image; a transfer device that transfers the toner image developed by the developing device from the image carrier onto a recording medium; and a cleaning device that removes residual toner from the image carrier from which the toner image has been transferred. The developing device includes a first developer carrier that rotates in a same direction as a rotating direction of the image carrier so as to supply developer to the image carrier; and a second developer carrier that rotates in a direction opposite to the rotating direction of the image carrier so as to supply the developer to the image carrier. The developing device simultaneously performs a refreshing operation of performing replacement of the developer and a filming removal operation of causing the image carrier to rotate idle while forming an image for use in the refreshing operation and causing the first and second developer carriers to rotate in their respective rotating directions.

According to another aspect of the present invention, there is provided an image forming method performed in an image forming apparatus. The image forming apparatus includes an image carrier on which an electrostatic latent image is to be formed, a developing device that develops the electrostatic latent image into a toner image, a transfer device that transfers the toner image developed by the developing device from the image carrier onto a recording medium, and a cleaning device that removes residual toner from the image carrier from which the toner image has been transferred. The developing device includes a first developer carrier that rotates in a same direction as a rotating direction of the image carrier so as to supply developer to the image carrier and a second developer carrier that rotates in a direction opposite to the rotating direction of the image carrier so as to supply the developer to the image carrier. The image forming method includes simultaneously performing a refresh operation of performing replacement of the developer and a filming removal operation of causing the image carrier to rotate idle while forming an image for use in the refreshing operation and causing the first and second developer carriers to rotate in their respective rotating directions.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

Figure 1:
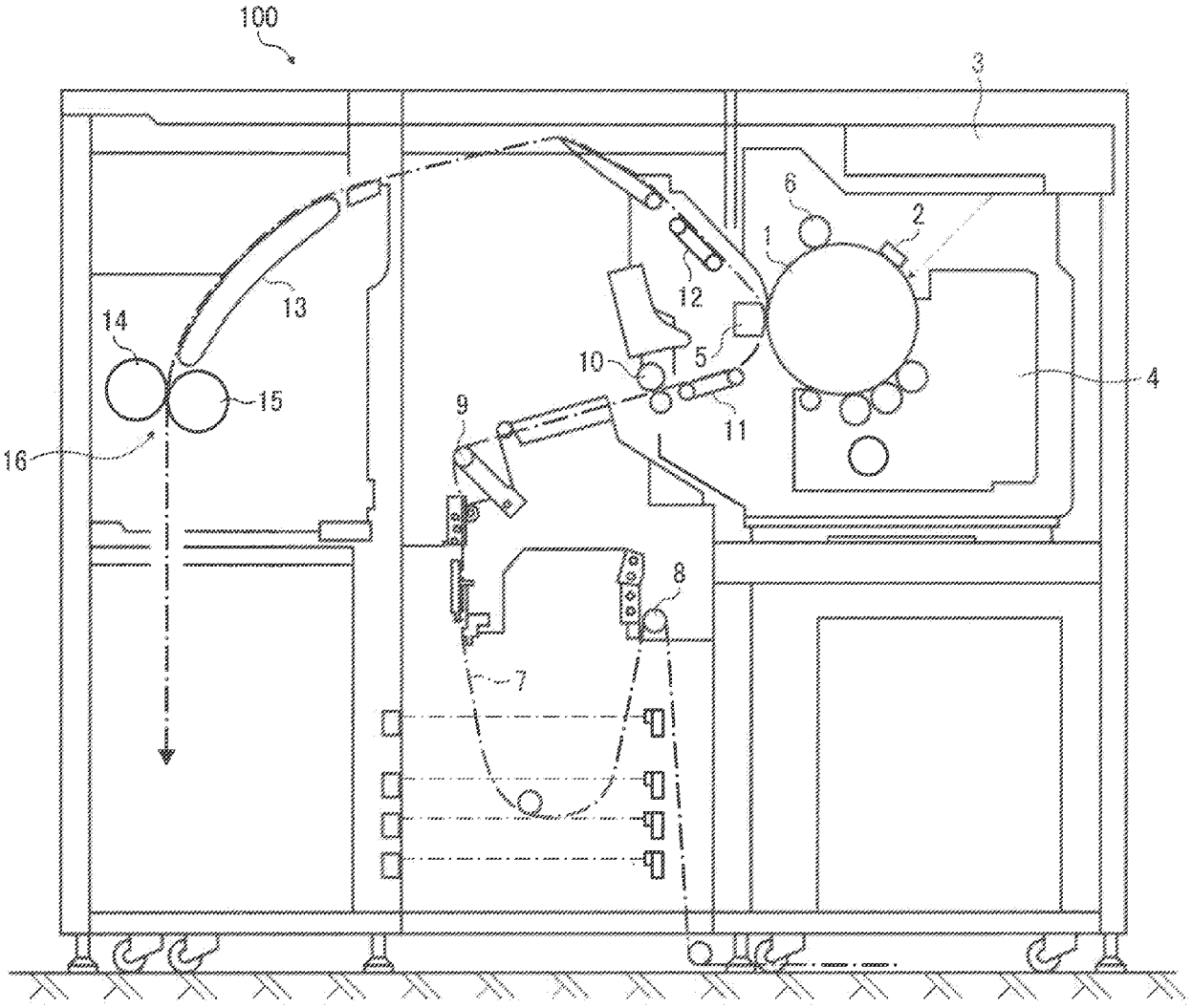
FIG. 1 is a schematic diagram illustrating the configuration of an image forming apparatus according to an embodiment of the present invention.

FIG. 1 is a schematic diagram illustrating overall configuration of an image forming apparatus 100 according to an embodiment of the present invention. As illustrated in FIG. 1, the image forming apparatus 100 includes a photoconductor 1, and an electrostatic charger 2, an exposure device 3, a developing device 4, a transfer unit 5, and a cleaning brush 6 that are arranged along the rotating direction of the photoconductor 1.

After a uniform electrostatic charge is applied on the surface of the photoconductor 1, which is an image carrier, by the electrostatic charger 2, the surface of the photoconductor 1 is exposed to laser light emitted from the exposure device 3 according to image data.

An electrostatic latent image is formed on the surface of the photoconductor 1 constructed as described above. The latent image is developed by the developing device 4 into a toner image on the surface of the photoconductor 1.

As the photoconductor 1, a positively-charged photoconductor, such as a selenium photoconductor, an organic photoconductor (OPC), or amorphous silicon (a-Si), can be used.

As a developing method for the photoconductor 1, a reversal developing method, in which toner is positively charged, is employed.

Continuous paper 7 is conveyed by conveyers 8 to 12 to the transfer unit 5 where the toner image is transferred onto the continuous paper 7.

While the toner image passes through a pre-heater 13, the toner image on the continuous paper 7 is heated to near a transfer temperature of toner resin. Thereafter, the toner image is fused and fixed onto the continuous paper (paper medium) 7 by a fixing device 16 that includes a heating roller 14, which incorporates a heater, and a backing-up roller 15. Recording paper, which is the paper medium onto which the toner image has been fixed, is delivered to the outside of the image forming apparatus.

After the transfer operation, residual toner adhering to the surface of a drum of the photoconductor 1 is removed by the cleaning brush 6 and sucked by a blower (not shown). The residual toner is delivered to a cyclone filter and then to a waste toner box. Thereafter, residual charge on the photoconductor 1 is neutralized by an eliminating lamp (not shown) that eliminates the electrostatic charge (to 0 volt).

Figure 2:
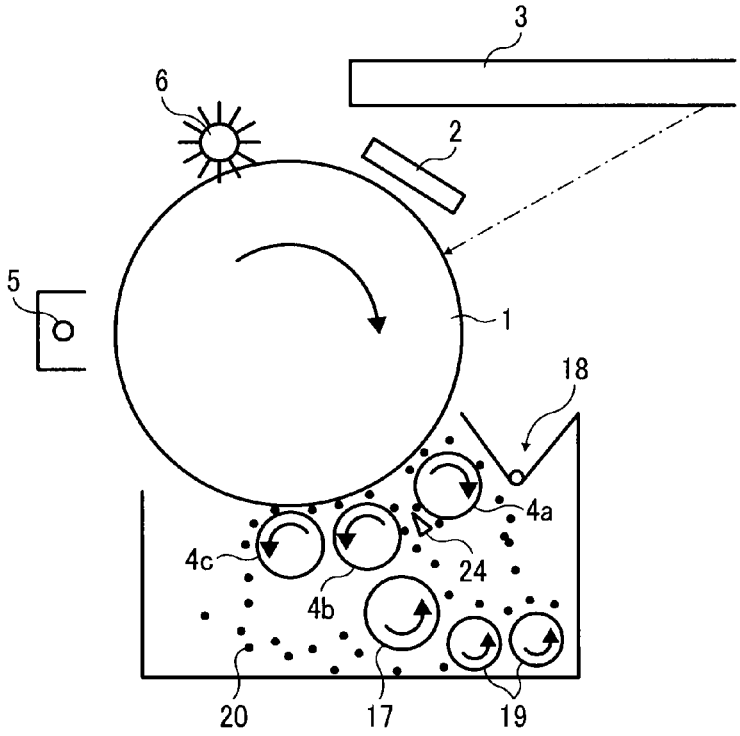
FIG. 2 is an enlarged view of a printing unit in the image forming apparatus illustrated in FIG. 1.

FIG. 2 is an enlarged view of a printing unit in the image forming apparatus illustrated in FIG. 1.

Referring to FIG. 2, the image forming apparatus 100 is configured to develop an electrostatic latent image formed on the photoconductor 1 into a visible image with a two-component developer that contains insulative toner and magnetic carrier and to positively charge the toner and negatively charge the carrier by triboelectrification. How the image forming apparatus 100 forms an image with the two-component developer is described below.

The developing device 4 includes a developer agitating unit 19, a conveying roller 17, and developing rollers 4*a*, 4*b*, and 4*c*, and houses therein a developer 20, which is the two-component developer. The developer agitating unit 19 agitates the toner and the carrier in the developer 20, causing the toner and the carrier to be triboelectrically charged. The developing rollers 4*a*, 4*b*, and 4*c* include magnets that are arranged inside the developing rollers 4*a*, 4*b*, and 4*c* and fixed thereto. Only the developing roller 4*a* (first developer carrier) rotates in the same direction as the rotating direction of the photoconductor 1 whereas the developing rollers 4*b* and 4*c* (second developer carrier) rotate in the direction opposite to the rotating direction of the photoconductor 1. The developer 20 is transferred from the conveying roller 17 to the developing roller 4*b*. An amount of the developer 20 to be fed to a nip between the photoconductor 1 and the developing roller 4*b* is regulated by a regulation plate 24 such that the amount of the developer 20 is regulated by each of a doctor gap between the regulation plate 24 and the developing roller 4*a* and a doctor gap between the regulation plate 24 and the developing roller 4*b*.

The developing rollers 4*a*, 4*b*, and 4*c* are configured to receive developing bias voltage that is supplied from a high-voltage power supply (not shown).

The developing device 4 is configured so as to monitor toner concentration, which is a ratio between the carrier and the toner, and to supply toner from a toner hopper 18 as required when the toner concentration deviates from a reference value range.

Development with the two-component developer can be performed under the following condition.

The photoconductor 1 that has been electrostatically charged to have a surface potential of 700 volts is exposed to light of an image to form an electrostatic latent image that has residual potential of 50 volts on the photoconductor 1. The electrostatic latent image is developed by application of a developing bias voltage of 350 volts. This causes negatively-charged toner held on a magnetic brush of the carrier that is formed on the developing roller 4*a* (sleeve) to be electrostatically attracted only to portions of the latent image.

Reversal development with the two-component developer is performed in this manner to form the toner image on the photoconductor 1.

The present inventors conducted an experiment on filming removal under the following condition with the configuration described above. A control unit 101 illustrated in FIG. 3 was used as a unit for use in carrying out this experiment.

Figure 3:
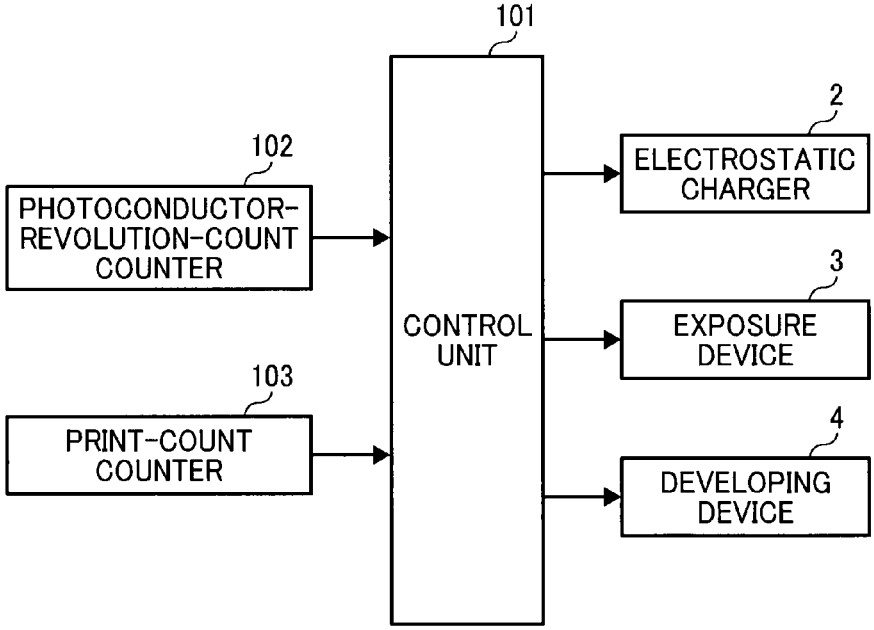
FIG. 3 is an explanatory block diagram of a control unit that performs a procedure for a refresh operation to be performed in the image-forming system illustrated in FIG. 1.

Referring to FIG. 3, the control unit 101 is coupled, at its input end, to a photoconductor-revolution-count counter 102 and a print-count counter 103 and, at its output end, to the electrostatic charger 2, the exposure device 3, and the extra developing device 4.

The electrostatic charger 2 coupled to the output end of the control unit 101 is configured to be capable of setting surface potential of the photoconductor 1 during the refresh operation to a potential that causes background fog, that differs from a potential for normal image forming operation. The exposure device 3 is used to control a pixel density. The developing device 4 is configured such that a developing speed is selectable (changeable).

Figure 6:
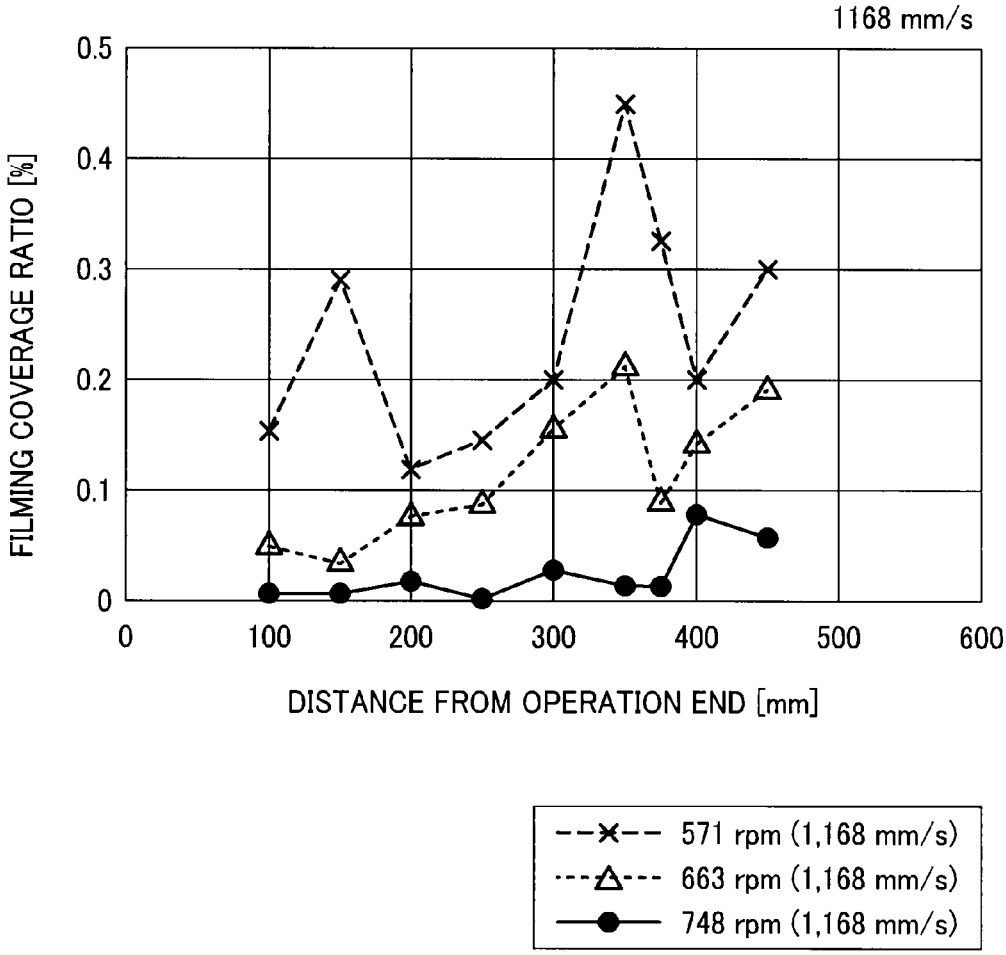
FIG. 6 is an explanatory diagram illustrating relationship between rotation speed of a developing roller provided in a developing device in the image forming apparatus and filming buildup.

Print speed of the image forming apparatus 100 was set to 1,168 millimeter per second (mm/s) (46 inch/s). As for the number of revolutions of the developing magnetic roller, three conditions, or, more specifically, 571 revolutions per minute (rpm), 663 rpm, and 748 rpm were set. Printing of 20,000 sheets of paper was performed with surface potential of 700 volts, a bias potential of 350 volts, and a toner concentration of approximately 4%. A filming coverage ratio, which is a ratio of an area of filming, was obtained by assuming points at which brightness was equal to or lower than a threshold value, as filming in a photomicrograph of the formed image. FIG. 6 illustrates the obtained filming coverage ratio.

In FIG. 6, the horizontal axis represents the distance from the end of an operation side of the photoconductor 1. The result indicates that as the peripheral speed increases, the filming coverage ratio decreases, or, put another way, scraping off is performed more effectively. It is indicated in particular that the peripheral speed of the developing roller is preferably high.

However, when the peripheral speed exceeds 900 rpm, an amount of carrier transfer increases. Accordingly, 500 to 800 rpm is desirable as the peripheral speed.

An experiment, in which only the cleaning brush and the developing roller were rotated with the photoconductor 1 stopped, was carried out. As a result of idling rotation of duration of approximately three minutes, visible filming was formed at positions of the brush and the magnetic roller.

This experiment indicates that the photoconductor 1 should desirably be neither stopped nor decelerated when the cleaning brush or the magnetic developing roller rotates.

In other words, it is indicated that more effective filming scraping can be achieved during idling rotation by setting the peripheral speed of the magnetic roller high and causing both the photoconductor 1 and the cleaning brush to rotate as in normal image forming operation.

It is apparent that even with a configuration where the developing device 4 includes a plurality of developing rollers, scraping off of the photoconductor 1 is not attained during forward rotation because vector of the velocity of the photoconductor 1 and that of the developing rollers are of the same direction during the forward rotation. In consideration of this, the image forming apparatus 100 illustrated in FIG. 1 is configured to include the plurality of developing rollers, one developing roller of which is configured to rotate in the direction opposite to the rotating direction of the photoconductor 1 at a position where the one developing roller opposes the photoconductor 1. Accordingly, this image forming apparatus 100 is capable of efficient scrape-off operation by using developer.

Procedures for filming removal and refresh operation according to embodiments of the present invention are described below.

First Embodiment

A sequence of filming scraping (removal) operation and a refreshing operation is described below. Description about principle of the image forming apparatus 100 has already been described above, and therefore omitted.

Figure 4:
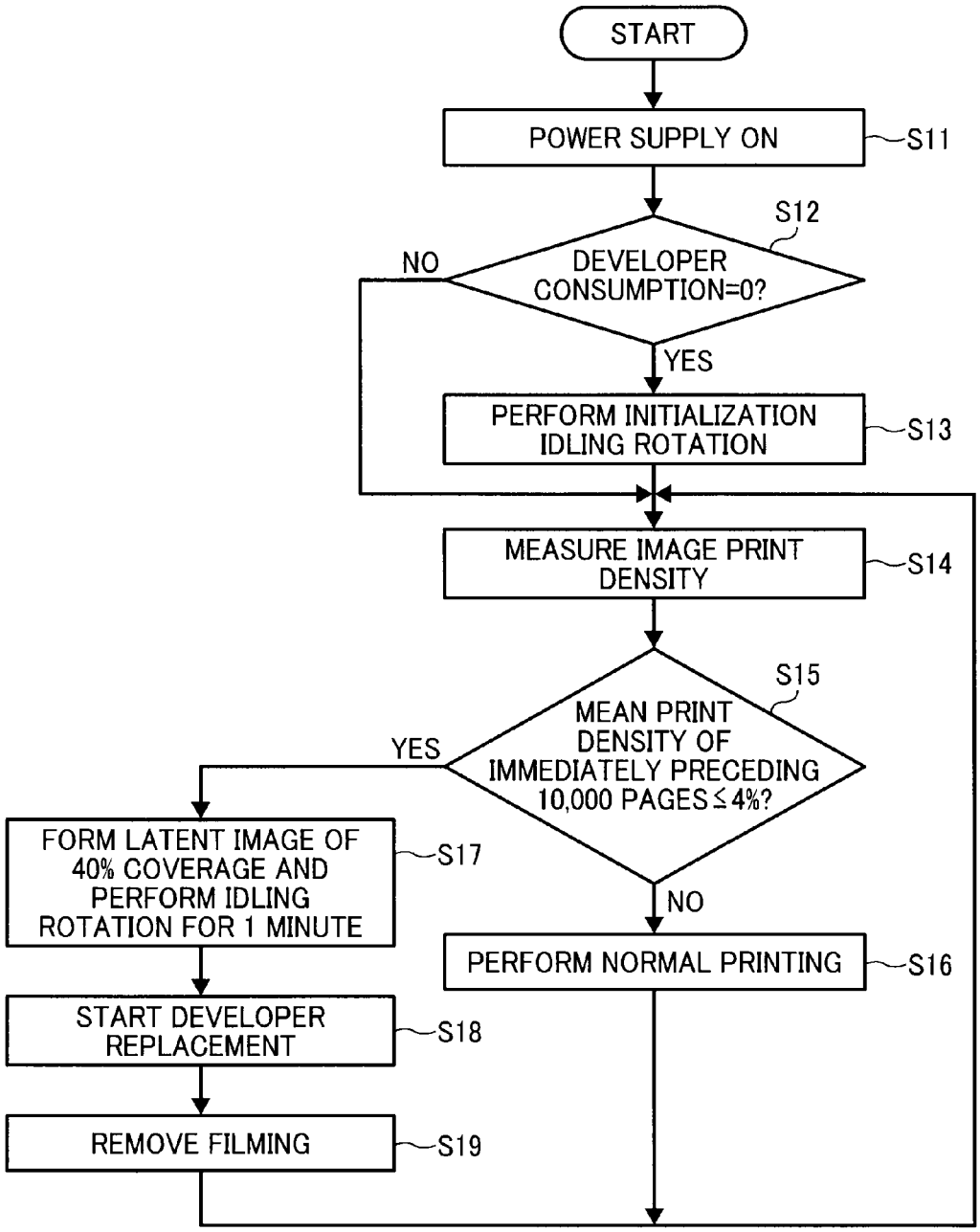
FIG. 4 is a flowchart of an operating procedure to be performed in an image forming apparatus according to a first embodiment of the present invention.

Referring to FIG. 4, when power supply to the image forming apparatus 100 is turned ON (Step S11), the control unit 101 determines whether developer consumption is zero by determining whether a count of a developer counter is zero until the temperature of the fixing device 16 reaches a predetermined temperature (Step S12). When the developer consumption is zero (YES at Step S12), the photoconductor 1 is a new one. Accordingly, the developing device 4 performs initialization idling rotation of the photoconductor 1 as is usual (Step S13).

In contrast, if the developer consumption is not zero (NO at Step S12); or, in other words, the count of the developer counter is not zero, the developing device 4 does not perform the initialization idling rotation of the photoconductor 1.

Subsequently, the control unit 101 measures image print density (Step S14). The control unit 101 calculates a mean print density of immediately preceding 10,000 pages to determine whether the calculated mean print density is equal to or smaller than 4%, which is a value stored in advance (Step S15). If the mean print density is equal to or smaller than 4% (YES at Step S15), the control unit 101 determines that time for starting a toner refresh operation and a filming removal operation has come. Hence, the developing device 4 forms a halftone latent image of 40% coverage and causes the photoconductor 1 to rotate idle for one minute (Step S17).

The developing device 4 develops the electrostatic latent image formed on the photoconductor 1 (image carrier) to replace toner in the developing device 4, thereby performing the refresh operation (Step S18). The developing device 4 performs, simultaneously with the refresh operation, the filming removal operation by using developer that is supplied to take place of the toner in the developing device 4 (Step S19). More specifically, while supplying developer and causing the photoconductor 1 to rotate idle, the developing device 4 causes the developing roller 4*a* to rotate in the same direction as the rotating direction of the photoconductor 1 and the developing rollers 4*b* and 4*c* to rotate in the direction opposite to the rotating direction of the photoconductor 1. This causes the surface of the photoconductor 1 to be scraped off due to rotations of the developing rollers 4*b* and 4*c* and hence filming to be removed from the surface of the photoconductor 1. The developing device 4 performs the refreshing operation and the filming removal operation simultaneously in this manner.

If the mean print density is greater than 4% (NO at Step S15), toner has been replaced adequately. Accordingly, normal printing is performed with neither the refreshing operation nor the filming removal operation performed (Step S16).

No filming was observed even as many as 300,000 pages were printed with the procedure described above.

Second Embodiment

Figure 5:
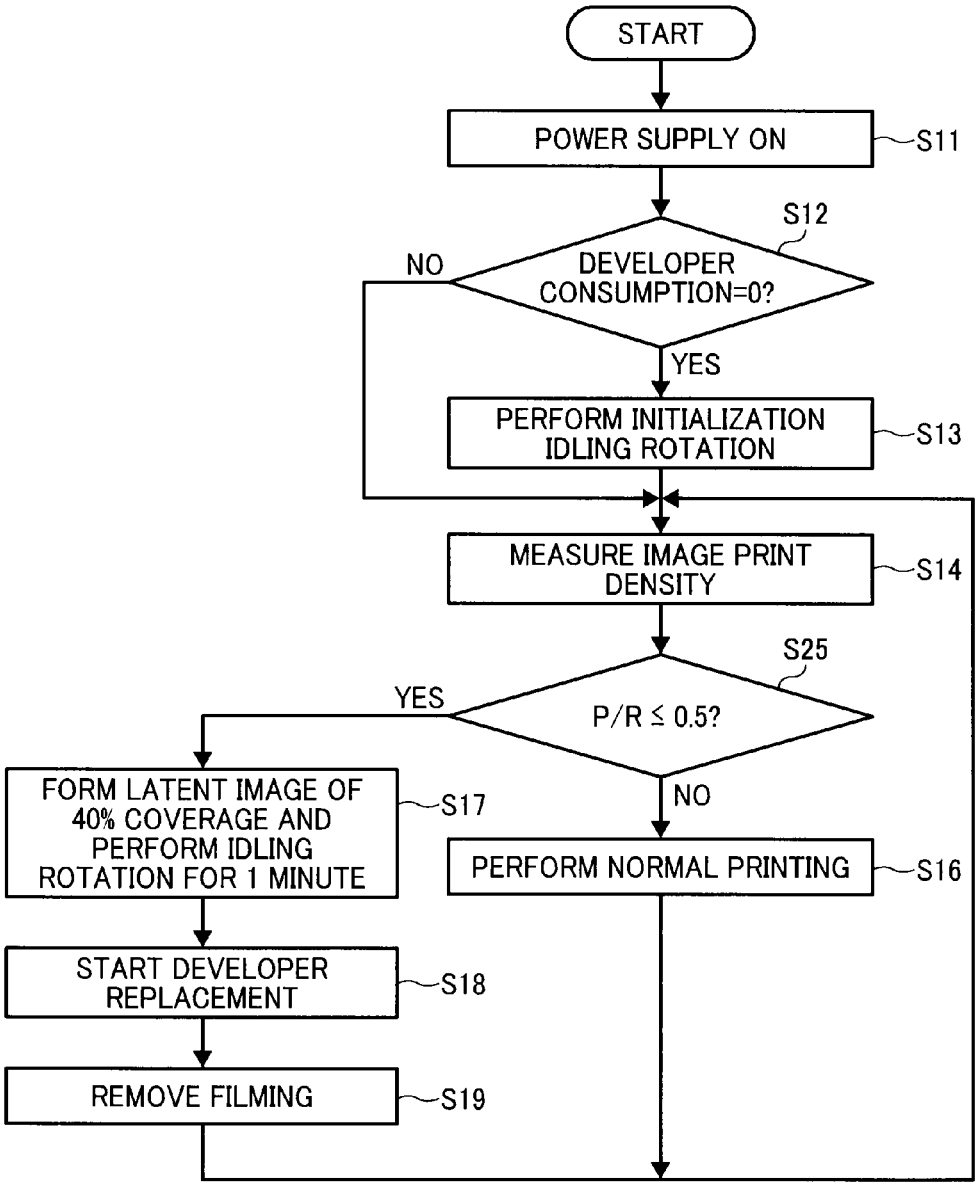
FIG. 5 is a flowchart illustrating an operating procedure to be performed in an image forming apparatus according to a second embodiment of the present invention.

The procedure illustrated in FIG. 5 is employed when intermittent printing is to be performed. It should be noted that same operation as that in the flowchart illustrated in FIG. 4 is denoted by the same step number. Operations from switch-on of the power supply to initialization idling rotation (Step S11 to Step S13) are performed as in the first embodiment.

When printing is started, the control unit 101 measures image print density (Step S14). Subsequently, the control unit 101 calculates a mean print density of immediately preceding 10,000 pages and calculates a ratio P/R where R is the number of revolutions of the photoconductor 1 obtained by the photoconductor-revolution-count counter 102 and P is the number of printed pages.

The control unit 101 determines whether P/R is equal to or smaller than 0.5, which is a preset value (Step S25). If P/R is equal to or smaller than 0.5, a series of short print jobs is being performed; accordingly, even when actual print density is high, apparent print density is calculated to be low. In this case, as in the first embodiment, the control unit 101 determines that time for starting the toner refresh operation has come. Hence, the developing device 4 forms a halftone latent image of 40% coverage and thereafter causes the photoconductor 1 to rotate idle for one minute (Step S17). The developing device 4 develops the latent image on the photoconductor 1 so that toner in the developing device 4 is replaced, thereby performing the refresh operation (Step S18). Simultaneously, the developing device 4 performs the filming removal operation by using developer that is supplied to take place of the toner in the developing device 4 (Step S19). More specifically, as in the first embodiment, while supplying developer and causing the photoconductor 1 to rotate idle, the developing device 4 causes the developing roller 4*a* to rotate in the same direction as the rotating direction of the photoconductor 1 and the developing rollers 4*b* and 4*c* to rotate in the direction opposite to the rotating direction of the photoconductor 1, thereby removing filming from the surface of the photoconductor 1. As described above, the developing device 4 according to the second embodiment also performs the refreshing operation and the filming removal operation simultaneously.

If P/R is greater than 0.5 (NO at Step S25), normal printing is continued (Step S16).

No filming was observed even as many as 300,000 pages were printed with the procedure described above.

In the first embodiment and the second embodiment, low-density printing and intermittent printing have been described. For a situation where low-density printing and intermittent printing are performed consecutively, a determination as to which one of the low-density printing and intermittent printing is being performed can be made to perform the toner refresh operation and the filming removal operation according to a result of the determination.

The reason why a duration of the idling rotation is one minute is that one minute is long enough to replace toner in the developing device 4 for an apparatus capable of forming a halftone image of 40% coverage at a print speed of 1,000 mm/s or higher.

Third Embodiment

In a third embodiment of the present invention, the image forming apparatus 100 illustrated in FIG. 1 is configured such that a print speed is selectable from, for instance, two print speeds of 1,168 mm/s (46 inch/s) and 1,422 mm/s (56 inch/s). The image forming apparatus according to the third embodiment is similar to the image forming apparatus according to the first and second embodiments except for that idling rotation in the refreshing operation is performed under conditions, which include the number of revolutions of the developing roller and a condition related to the cleaning device, for a faster one of the print speeds, or, more specifically, 1,422 mm/s. If the image forming apparatus is configured such that the print speed is selectable among three or more print speeds, conditions including the number of revolutions of the developing roller and a condition related to the cleaning device for a fastest one of the print speeds are desirably selected.

Fourth Embodiment

According to a fourth embodiment of the present invention, the image forming apparatus 100 illustrated in FIG. 1 is configured to have a relatively small difference between a surface potential and a bias potential during the filming removal operation to attain a background-fog potential that causes background fog, so as to consume toner. For instance, a surface potential and a bias potential can be set during idling rotation to 500 volts and 350 volts, respectively whereas a surface potential and a bias potential are set during normal printing to 700 volts and 350 volts, respectively. This scheme allows idling rotation while alleviating carrier scattering to some extent. The fourth embodiment is similar to the first and second embodiments except for the configuration discussed above.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier on which an electrostatic latent image is to be formed;

a developing device that develops the electrostatic latent image into a toner image;

a transfer device that transfers the toner image developed by the developing device from the image carrier onto a recording medium; and a cleaning device that removes residual toner from the image carrier from which the toner image has been transferred, wherein the developing device includes:

a first developer carrier that rotates in a same direction as a rotating direction of the image carrier so as to supply developer to the image carrier; and a second developer carrier that rotates in a direction opposite to the rotating direction of the image carrier so as to supply the developer to the image carrier, and the developing device simultaneously performs a refreshing operation in which the developer is replaced with respect to the developing device, and a film removal operation with respect to a film formed on the image carrier, in which the image carrier rotates idly and has an image used in the refreshing operation formed thereon, and the first and second developer carriers rotate in their respective rotating directions.

2. The image forming apparatus according to claim 1, wherein the developer is a two-component developer, and a surface of the image carrier is scraped off by magnetic brush formed by the two-component developer.

3. The image forming apparatus according to claim 1, further comprising a control unit that determines whether a mean print density immediately preceding 10,000 pages is equal to or smaller than 4%, wherein the developing device performs the refresh operation when the mean print density is equal to or smaller than 4%.

4. The image forming apparatus according to claim 1, further comprising a control unit that determines whether a ratio P/R is equal to or smaller than 0.5, where P is number of printed pages and R is number of revolutions of the image carrier, wherein the developing device performs the refresh operation when the P/R is equal to or smaller than 0.5.

5. The image forming apparatus according to claim 1, wherein the developing device sets, during the refresh operation, surface potential of the image carrier to a potential that causes background fog.

6. The image forming apparatus according to claim 1, wherein a print speed of printing with use of the image carrier is set to be equal to or higher than 1,000 mm/s.

7. The image forming apparatus according to claim 6, wherein the print speed is changeable.

8. The image forming apparatus according to claim 1, wherein the image used in the refreshing operation is a half-tone latent image.

9. The image forming apparatus according to claim 1, wherein the developer in the developing device is replaced with a new developer.

10. The image forming apparatus according to claim 1, wherein the developer includes toner.

11. The image forming apparatus according to claim 1, wherein a replacement developer that replaces the developer includes toner.

12. The image forming apparatus according to claim 1, wherein a print density of the image used in the refreshing operation is in a range of 30% to 50%.

13. An image forming method performed in an image forming apparatus that includes an image carrier on which an electrostatic latent image is to be formed, a developing device that develops the electrostatic latent image into a toner image, a transfer device that transfers the toner image developed by the developing device from the image carrier onto a recording medium, and a cleaning device that removes residual toner from the image carrier from which the toner image has been transferred, the developing device including a first developer carrier that rotates in a same direction as a rotating direction of the image carrier so as to supply developer to the image carrier and a second developer carrier that rotates in a direction opposite to the rotating direction of the image carrier so as to supply the developer to the image carrier, the image forming method comprising:

simultaneously performing a refreshing operation in which the developer is replaced with respect to the developing device, and a film removal operation with respect to a film formed on the image carrier, in which the image carrier rotates idly and has an image used in the refreshing operation formed thereon, and the first and second developer carriers rotate in their respective rotating directions.

14. The image forming method according to claim 13, wherein the image used in the refreshing operation is a half-tone latent image.

15. The image forming method according to claim 13, wherein the developer in the developing device is replaced with a new developer.

16. The image forming method according to claim 13, wherein the developer includes toner.

17. The image forming method according to claim 13, wherein a replacement developer that replaces the developer includes toner.

18. The image forming method according to claim 13, wherein a print density of the image used in the refreshing operation is in a range of 30% to 50%.

* * * * *